US006128882A

United States Patent [19]

Jones

[11] Patent Number: 6,128,882

[45] **Date of Patent: *Oct. 10, 2000**

[54] TIE FOR REINFORCING BARS

[75] Inventor: Cecil Gwilliam Jones, Wynnum, Australia

[73] Assignee: Ironbar Pty Ltd, Queensland, Australia

[ * ] Notice: This patent is subject to a terminal disclaimer.

[21] Appl. No.: 09/237,602

[22] Filed: Jan. 25, 1999

Related U.S. Application Data

[63] Continuation of application No. 08/746,149, Nov. 4, 1996, Pat. No. 5,913,341, and a continuation of application No. 08/481,375, Jun. 13, 1995, abandoned, and a continuation of application No. PCT/AU93/00652, Dec. 14, 1993.

[30] Foreign Application Priority Data

Dec. 14, 1992 [AU] Australia ..... PL6325
Dec. 14, 1993 [AU] Australia ..... 00652/93

[51] Int. Cl.[7] ..... E04C 5/18; F16B 1/00; F16B 2/24

[52] U.S. Cl. ..... 52/665; 52/712; 52/719; 24/27; 140/53

[58] Field of Search ..... 52/719, 712, 665; 24/27; 140/53

[56] References Cited

U.S. PATENT DOCUMENTS

| | | |
|---|---|---|
| 1,185,263 | 5/1916 | Symons . |
| 1,512,763 | 10/1924 | Homgreen . |
| 3,132,396 | 5/1964 | Berman . |
| 3,169,559 | 2/1965 | Working . |
| 3,234,616 | 2/1966 | Wantland . |
| 3,302,348 | 2/1967 | Pratt . |
| 3,786,841 | 1/1974 | Albrecht et al. . |
| 4,388,791 | 6/1983 | Anderson . |
| 4,483,119 | 11/1984 | Hernandez . |
| 4,798,231 | 1/1989 | Glaus et al. . |
| 5,094,567 | 3/1992 | Nista et al. . |
| 5,178,195 | 1/1993 | Glaus et al. . |
| 5,431,196 | 7/1995 | Forrester et al. . |
| 5,913,341 | 6/1999 | Jones . |

FOREIGN PATENT DOCUMENTS

| | | |
|---|---|---|
| 1005821 | 4/1952 | France . |
| 27 20 212 | 11/1977 | Germany . |
| 9206260 | 4/1992 | WIPO . |
| 9221839 | 12/1992 | WIPO . |
| 9302816 | 2/1993 | WIPO . |

*Primary Examiner*—Robert Canfield
*Attorney, Agent, or Firm*—Blakely Sokoloff Taylor & Zafman

[57] ABSTRACT

A tie device (1) is provided, for tying objects together, such as reinforcing bars (7, 8) prior to pouring concrete there-around. The tie device (1) comprises a pair of arms (2, 3) in a U- or V-shaped configuration, and has a hook (5, 6) at each end thereof. The hooks (5, 6) are designed to automatically interengage when brought together. An apparatus and method for tying the tie device (1) are also provided.

25 Claims, 16 Drawing Sheets

TIE FOR REINFORCING BARS

This application is a continuing application of U.S. Ser. No. 08/746,149 filed Nov. 4, 1996 in the name of Cecil Gwilliam Jones. U.S. Ser. No. 08/746,149 is now U.S. Pat. No. 5,913,341, and a continuation in part of Ser. No. 08/481,375, filed Jun. 13, 1995, abandoned, and a CIP of PCT/AU93/00652, filed Dec. 14, 1993.

BACKGROUND OF THE INVENTION

The present invention relates to a tie device, to tying apparatus and to methods for tying using said tie device, and in particular, to a tie device and apparatus and method which enables reinforcing bars or mesh, typically used in the construction industry, to be quickly and securely 'tied'.

Concrete used in the building industry has a high resistance to compressive forces, but a relatively low tensile strength. Steel bars, on the other hand, have high tensile strength, so therefore it is common practice to reinforce the concrete with such steel bars to provide the necessary resistance to tension forces. In order to achieve the required strength of the resultant concrete member, the reinforcing bars need to be accurately positioned and retained in position whilst the concrete is being poured into the formwork. In many structural members, for example, slabs, beams, columns and walls, the steel bars are laid at right angles to each other to form a grid.

It is common practice to secure the bars, where they cross, by manually tying them together with tie wires, that is, by looping the wire around the bars and twisting the free ends of the wire together. Standard pliers, or pliers designed to facilitate the twisting of the wire, are used. This practice however has serious shortcomings. It is labour intensive and time consuming, resulting in significant direct costs. Indirect costs also result, since the next stage of construction cannot be started until the concrete structural component is completed. Additionally, because of the amount of kneeling and bending involved, particularly in large slab construction, injuries to the knees and backs of workers is commonplace.

There are no known machines on the market which will perform this work, although various unsatisfactory attempts have been made over the years to produce such a machine or tool.

For a wire tying tool to be useful and therefore accepted in the industry, it must be safe, reliable, convenient to use, and commercially attractive (i.e. reasonable price and effective in reducing overall costs).

SUMMARY OF THE INVENTION

The present invention seeks to overcome the disadvantages of such prior art connection methods of tying reinforcing bars, by providing an apparatus, and it's associated method of operation, wherein the tying operation is automatically achieved by providing an apparatus and method, wherein, a wire tie device is provided at the tie location, and is then automatically twisted around the bars to effect connection of same.

The present invention also seeks to provide a uniquely designed tie device useful for tying about said reinforcing bars and which readily tied by either by conventional manual methods or by such a tying apparatus.

In one broad form the present invention provides a tie device constructed of substantially ductile material, comprising:

a pair of elongate arms extending from an intermediate portion of said device in a substantially U- or V-shaped configuration; and, hook means provided at the end portion of each said arm;

whereby, at least one of said hook means is shaped to at least partly extend out of the plane of the remainder of said tie device, such that, upon application of an inward force, said hook means move together and automatically interengage, aid, upon subsequent release of said force, said hook means remain interengaged in a connected position.

In a preferred form said shaped hook(s) is/are of substantially a spiral shape, or other gradual smooth shape.

In an alternative form said shaped hook(s) is/are shaped having at-least one defined bend or corner.

Preferably, in use, after said hook means are in said connected position, said device is adapted to be twisted such that is is tightened about one or more object(s) to be tied.

Most preferably, said device is used for tying two or more reinforcing bars together.

In a further broad form, the present invention provides a tying apparatus for tying a tie device about one or more object(s) to be tied, said tie device characterised in being substantially U- or V-shaped and having hook means at the end portions thereof, said tying apparatus comprising:

delivery means, to deliver said tie device to a tying position substantially about said object(s);

connecting means to interengage and connect said hook means; and, twisting means to twist and thereby tighten said tie device about said object(s).

Preferably, said delivering means comprises:

a magazine to contain a plurality of said tie devices and dispense each tie device, one at a time; and, transfer means to move said tie device to a tying position substantially about one or more object(s) to be tied.

Also, preferably, said connecting means comprise a pair of couplers, one for each hook means of said tie device, each coupler adapted to cooperate with and move its respective hook means for interengagement with the other of said hook means.

In a preferred form said twisting means is adapted to operatively engage with part of said tie device after it is positioned about and when it substantially encircles said object(s), and twist said tie such that it is tightened about said object(s).

Preferably, each of said delivery means, said connecting means, and said twisting means are mechanically, hydraulically, pneumatically, electrically and/or electromechanically operated.

In a preferred embodiment of the invention, the device is provided with an elongate handle for holding/operating said device.

Most preferably, the device is used for tying two or more reinforcing bars together.

In a further broad form, the present invention provides a method of tying a tie device about one or more object(s) to be tied, characterised in that said tie device is a substantially U- or V-shaped device having hook means at the end portions thereof, said method comprising the steps of:

providing each tie device, one at a time, substantially about one or more object(s) to be tied;

interengaging and connecting said hook means; and, twisting and tightening said tie device about said object(s).

Preferably, said providing step comprises delivering each tie device from a dispenser/magazine having a plurality of tie devices stored therein and transferring each device to a tying position substantially about said object(s) to be tied.

Most preferably, said interengaging and connecting step comprises utilising a pair of couplers, one for each hook means of said tie device, to cooperate with and move its respective hook means relative to the other of said hook means such that the hook means interengage and connects with the other of said hook means.

Also preferably, said twisting and tightening step comprises operatively engaging part of said tie device after it is positioned substantially about and encircles said object(s) and then rotating said engaged part of said tie device such that it becomes twisted and tightened about said object(s).

Preferably, each or all steps are performed by mechanical, hydraulic, pneumatic, electrical and/or electromechanical or otherwise operated means.

The most preferred form of the device is used for tying two or more reinforcing bars together.

BRIEF DESCRIPTION OF THE DRAWINGS

The present invention will become more fully understood from the following detailed description of a preferred but non-limiting embodiment thereof, in connection with the accompanying drawings, wherein.

DETAILED DESCRIPTION OF THE PREFERRED EMBODIMENTS

Figure 1A:
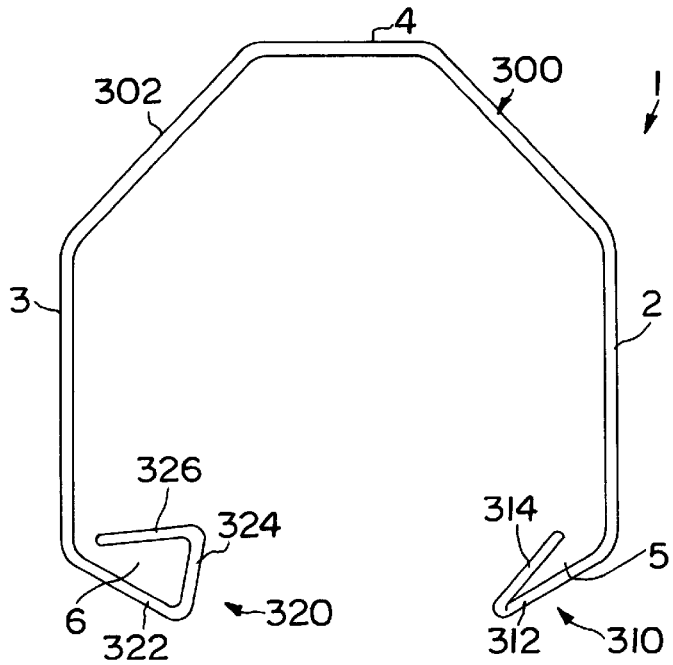
FIG. 1 shows, in FIGS. 1(*a*), 1(*b*), 1(*c*) and 1(*d*), elevational and underside views of the tie device in the open position, and elevational views of the device in the connecting position and the connected position, respectively.

In the drawings, like numerals identify similar features.

A preferred embodiment of a tie device is shown in FIG. 1 and generally designated by the numeral 1. The tie device 1 is preferably constructed of a substantially ductile material, such as metal, and is provided in a thin wire like formation. Of course, any other suitable material, such as plastic, and any other cross-sectional shape may be utilised. Basically, the tie device comprises a pair of elongate arms 2 and 3, extending from an intermediate portion 4 thereof in a substantially U- or V-like configuration. Hook means 5 and 6 are provided at each end portion of each arm 2 and 3, respectively. It will be noted that the tie device depicted in FIG. 1 is provided with hook means 5 and 6 of different shape, the hook 5 being of a two bends, bent back in the same plane as the remainder of the device 1, whilst the hook 6 has three bends, and extends out of the plane of the remainder of the tie device 1. The purpose for at least one of the hooks, in extending out of the plane of the remainder of the device 1, is such that "automatic" engagement of the two hooks may occur upon application of an inward force, as will be described hereinafter.

Figure 1B:
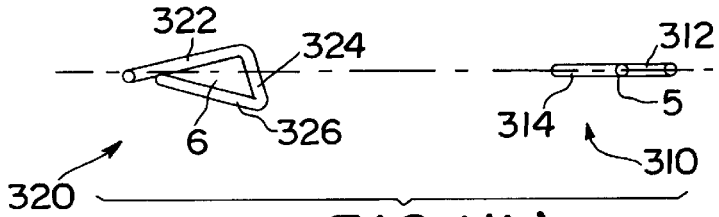

FIG. 1*b* perhaps better illustrates the "out of plane" bending of the hook 6 shown in FIG. 1*a*.

Figure 2A:
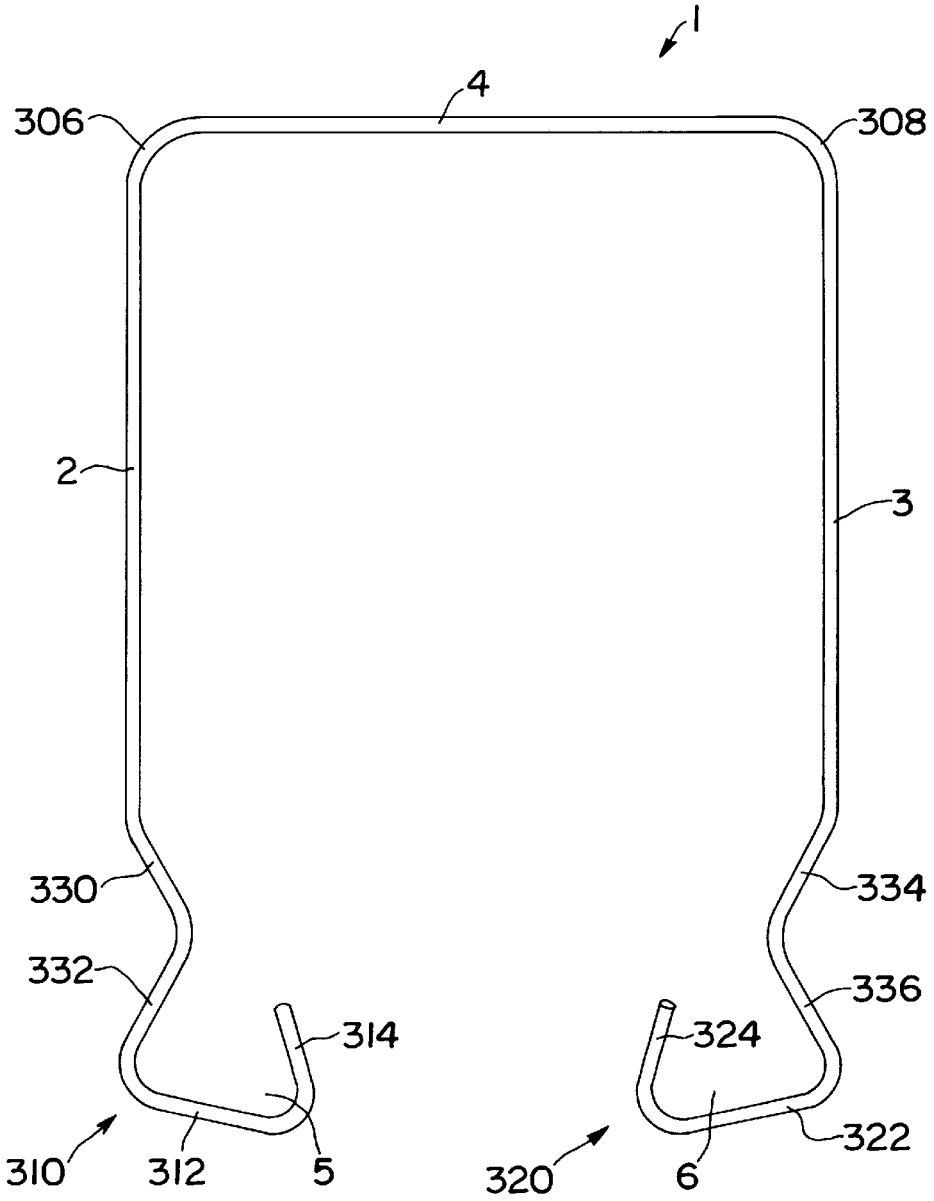
FIG. 2 illustrates, in FIGS. 2(*a*) and 2(*b*) thereof, elevational and underside views, respectively, of an alternative embodiment of the device.
Figure 2B:
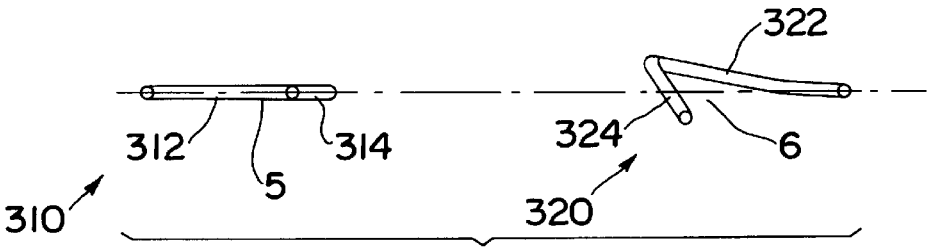
Figure 3A:
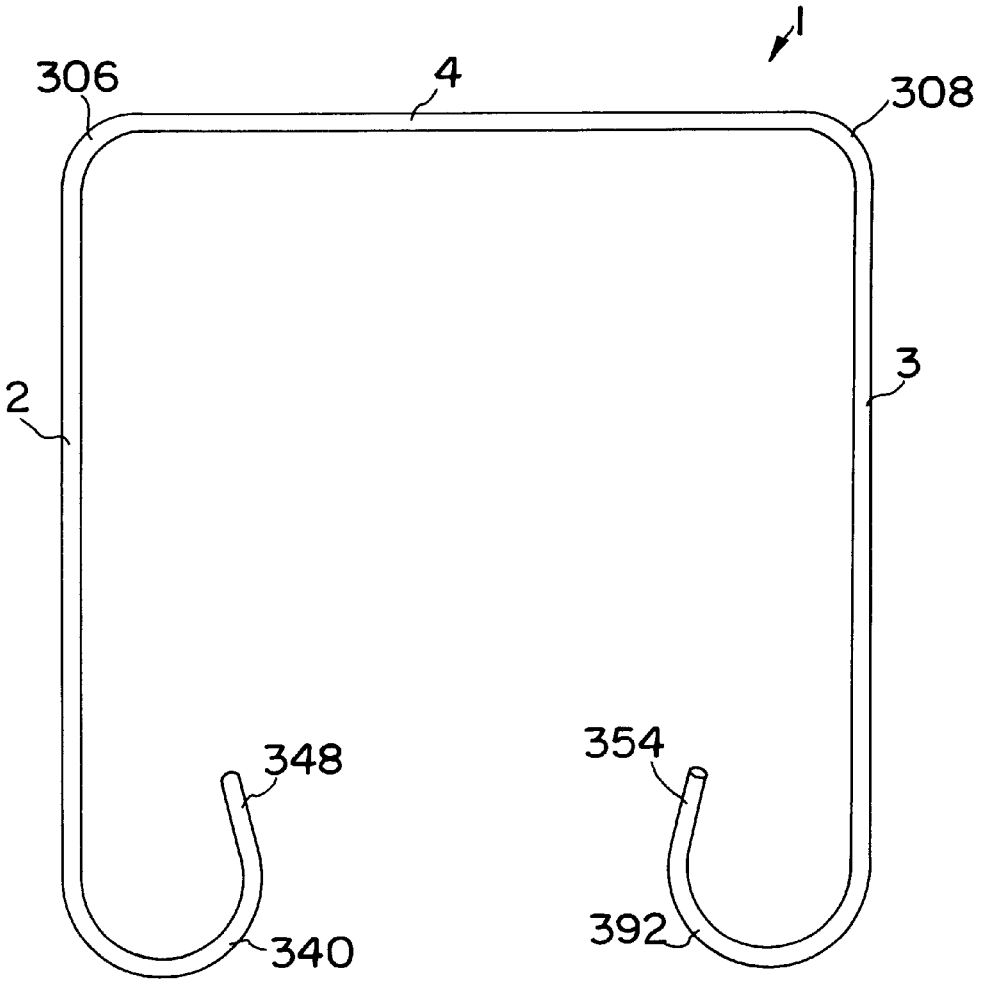
FIG. 3 illustrates, in FIGS. 3(*a*) and 3(*b*) thereof, elevational and underside views of yet a further embodiment of the tie device.

To further explain the illustrations in FIGS. 1*a*, 1*b*, 2*a*, and 2*b*, the tie device (or "tie") 1 is made of an intermediate portion 4 that is attached between a first elongated arm 2 and a second elongated arm 3. As shown in FIG. 1*a*, the intermediate portion 4 may be coupled to the first elongated arm 2 by a first angled portion 300 and may be coupled to the second elongated arm 3 by a second angled portion 302 such that the first angled portion 300 and the second angled portion 302 form a substantially V-like configuration. Alternatively, as shown in FIG. 2*a* and FIG. 3*a*, the intermediate portion 4 may be coupled to the first elongated arm 2 by a first curved portion 306 and may be coupled to the second elongated arm 3 by a second curved portion 308 such that the first curved portion 306 and the second curved portion 308 form a substantially U-like configuration.

As discussed above and shown in FIG. 1*a*, hook means 5 is attached at an end of first elongated arm 2 and hook means 6 is attached at an end of second elongated arm 3. In a preferred embodiment, hook means 5 is a hook 310 comprising a hook extension 312 and a grapple 314 as is shown in both FIG. 1*a* and FIG. 2*a*. In FIG. 1*a* and FIG. 2*a*, the hook extension 312 is attached to the first elongated arm 2 at an angle greater than ninety degrees and less than 180 degrees to form an obtuse angle. This obtuse angle is such that the hook extension 312 extends towards a plane running through the second elongated arm 3 that is perpendicular to the intermediate portion 4. The grapple 314 is attached to the hook extension 312 at an angle greater than zero degrees and less than ninety degrees to form an acute angle. This acute angle is such that the grapple 314 extends towards a plane running through the intermediate portion 4 that is perpendicular to the first elongated arm 2.

In FIG. 1*a* and FIG. 2*a*, hook means 6 is a loop 320 comprising a loop extension 322 and a catch 324. The loop extension 322 is coupled to the second elongated arm 3 at an obtuse angle so that the loop extension 322 extends towards a plane running through the first elongated arm 2 that is perpendicular to the intermediate portion 4. The catch 324 is coupled to the loop extension at an acute angle so as to extend towards a plane running through the intermediate portion 4 that is perpendicular to the first elongated arm 2.

In a preferred embodiment, the first elongated arm 2, the intermediate portion 4 and the second elongated arm 3 reside in a surface identified as a tie plane. Preferably, the hook 310 shown in both FIG. 1*a* and FIG. 2*a* resides in this tie plane as shown in FIG. 1*b* and FIG. 2*b*. To encourage "automatic"

engagement of the hook 310 with the loop 320, preferably the loop extension 322 extends away from the tie plane and the catch 324 extends towards the tie plane so as to pass through the tie plane as shown in FIG. 1*b* and FIG. 2*b*. To further secure this "automatic" engagement, the loop 320 of FIG. 1*a*, for example, may further comprise a catch extension 326 coupled to the catch 324 at an acute angle so as to extend in the direction of the tie plane as shown in FIG. 1*b* and towards a plane passing through the second elongated arm 3 that is perpendicular to the intermediate portion 4 as shown in FIG. 1*a*.

Figure 1C:
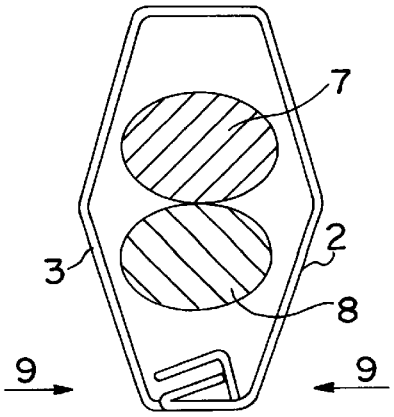
Figure 1D:
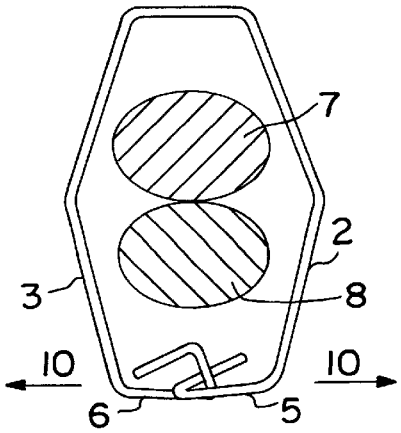

In use, the hook may be utilised to tie a pair of reinforcing bars 7 and 8, as depicted in FIGS. 1*c* and 1*d*. Once the hook is appropriately positioned around the objects to be tied, the hook portions 5 and 6 are moved in the direction of arrows 9 as shown in FIGS. 1*c* such that they "overlap". Then, upon subsequent release of the force, and due to the resilient nature of the material utilised in construction of the tie device, the arms 2 and 3 together with their respective hooks 5 and 6 move outwardly in the direction of arrows 10 as shown in FIG. 1*d*. In such position they therefore remain interengaged in the connected position. The hooks are shaped such as to not thereafter release from such connected position.

Examples of such tie devices are shown in FIGS. 2*a*, 2*b*, and 3*a*, 3*b* respectively. FIG. 2*a* illustrates an alternative version of a tie device 1 having defined bends or corners, and FIG. 3*a* illustrates a smoother twisted shape. Either one or both hooks may be twisted or bent.

To further explain the bends shown in FIG. 2*a*, each elongated arm of the tie device 1 may have a receding part and a protruding part that form a bend in each elongated arm. The first elongated arm 2 may have a receding part 330 as shown in FIG. 2*a* that extends towards the plane of the second elongated arm 3 that is perpendicular to the intermediate portion 4. Connected to the receding part 330 may be a protruding part 332 that extends away from the plane of the second elongated arm 3 that is perpendicular to the intermediate portion 4 so as to connect to the hook extension 312.

Similar to the first elongated arm 2, the second elongated arm 3 may have a receding part 334 as shown in FIG. 2*a* that extends towards the plane of the first elongated arm 2 that is perpendicular to the intermediate portion 4. Connected to the receding part 334 may be a protruding part 336 that extends away from the plane of the first elongated arm 2 that is perpendicular to the intermediate portion 4 so as to connect to the loop extension 320.

To further explain the smoother twisted shape shown in FIG. 3*a*, note that the end of each elongated arm has a part that is curved or bent like a hook. These "crooks" are designed to automatically engage when the resilient elongated arms are deformed towards one another and lock to one another when the resilient elongated arms work to return to their original position. As shown in FIG. 3*a*, a first crook 340 is coupled to the first elongated arm 2 and extends at least in part towards the plane of the second elongated arm 3 that is perpendicular to the intermediate portion 4. A second crook 342 is coupled to the second elongated arm 3 and extends at least in part towards the plane of the first elongated arm 2 that is perpendicular to the intermediate portion 4.

Figure 3B:
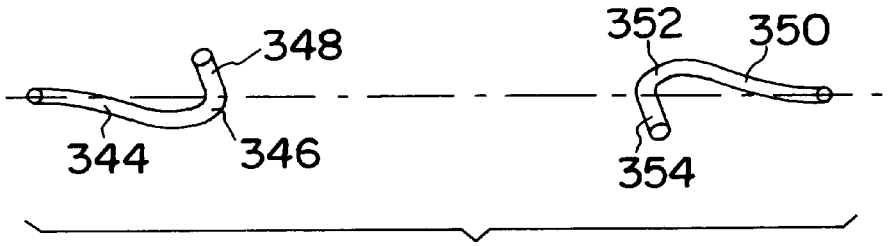

To aid in the automatic engagement of the crooks, the first crook 340 is comprised of a first portion 344 and a second portion 346 as shown in FIG. 3*b*. Preferably, the first portion 344 of the first crook 340 is coupled to the first elongated arm 2 and extends below and away from the tie plane. At a point of inflection of the first crook 340, the second portion 346 of the first crook 340 extends towards the tie plane. A first crook extension 348 attached to the second portion 346 of the first crook 340 passes through the tie plane. To further aid in the automatic engagement of the crooks, the second crook 342 is comprised of a first portion 350 and a second portion 352. Preferably, the first portion 350 of the second crook 342 is coupled to the second elongated arm 4 and extends below and away from the tie plane. At a point of inflection of the second crook 342, the second portion 352 of the second crook 342 extends towards the tie plane. A second crook extension 354 attached to the second portion 352 of the second crook 342 passes through the tie plane.

It will however be appreciated that gradual twisting or spiralling, rather than more defined bending, may allow the tie devices to nest more compatibly when provided with a plurality of other like tie devices in a magazine or the like.

It will be appreciated that the essential criteria in designing such alternative shaped tie devices is that they should be of appropriate characteristics and shape that, when pushed together in the direction of arrows 9 in FIG. 1*c*, and then subsequently released to move in the direction of arrows 10 in FIG. 1*d*, the hook portions 5 and 6 of the tie device 1 become interconnected. Other important and preferable features are that they nest so that they can be placed in a dispenser/magazine and delivered without becoming entangled, and, that the hooks are shaped such that when they interconnect around the objects to be tied, they provide a reliable anchorage against which the device is tightened.

Figure 4A:
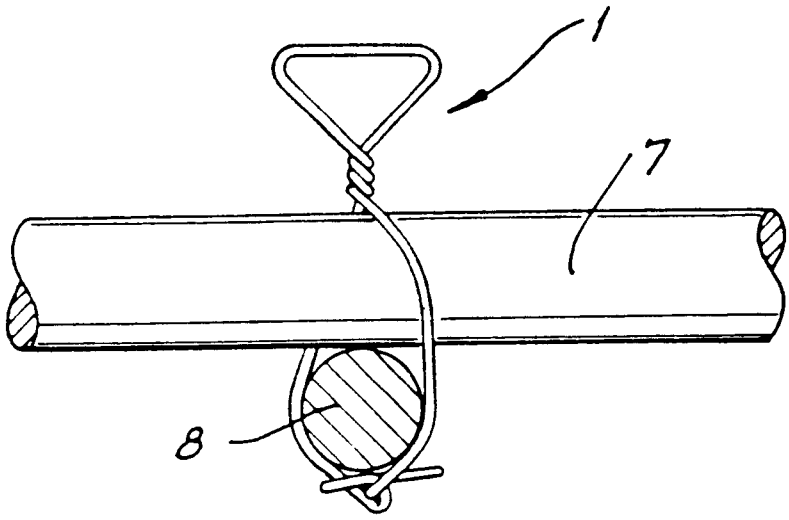
FIG. 4 shows in FIGS. 4(*a*) and 4(*b*) thereof respectively, elevational and underside views of the tie device of FIG. 1, but in a connected/tied position.
Figure 4B:
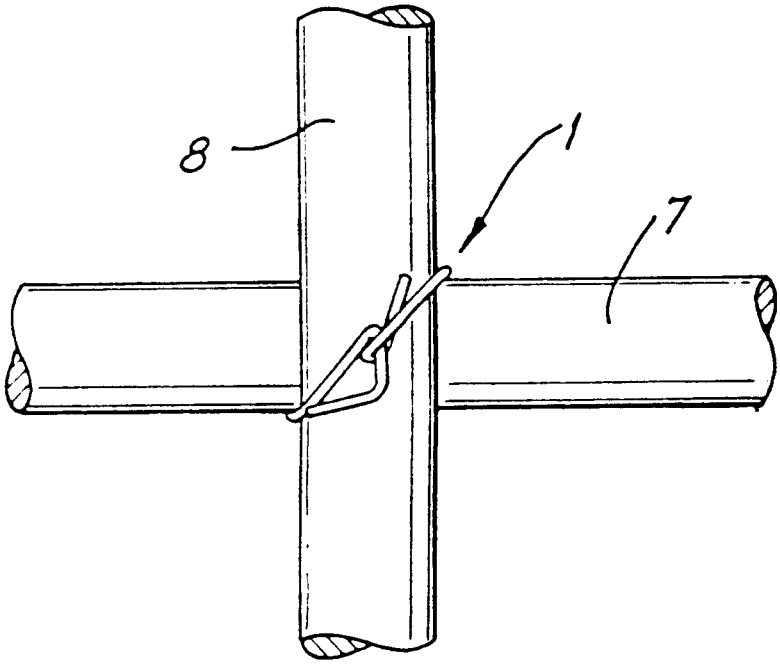

As illustrated in FIG. 4, which show elevational and underside views of the tie device, once connected about the objects to be tied 7 and 8, the tie device 1 is twisted such that the objects 7 and 8 become securely fastened together so that they cannot disengage.

The present invention also relates to a manual and/or automatic apparatus and method for effecting the supply, connection and twisting of these tie devices 1 about the objects to be tied 7 and 8. Details of the apparatus and the method for achieving this purpose will be hereinafter described.

Figure 5A:
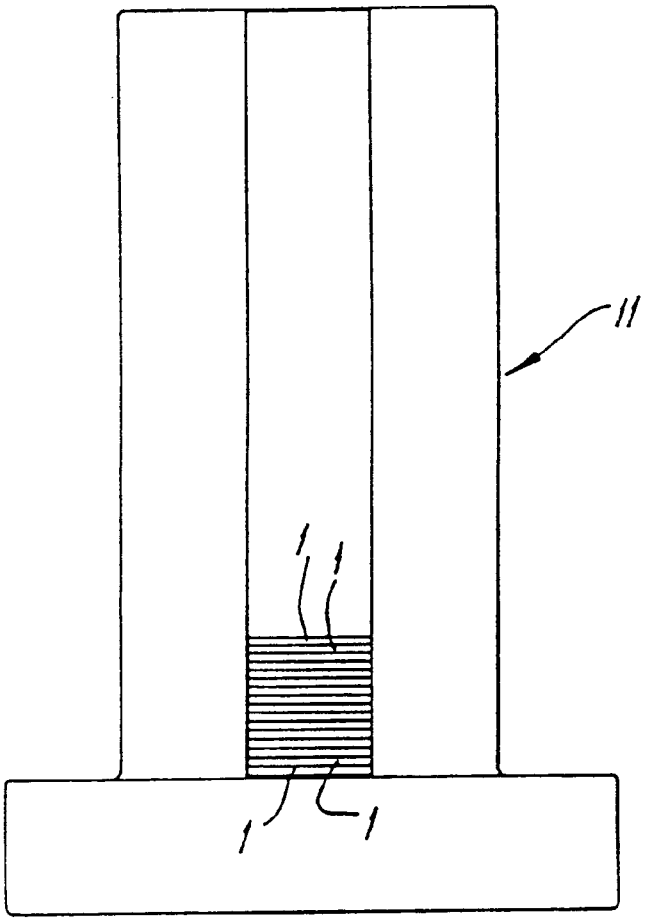
FIG. 5, in FIGS. 5(*a*) and 5(*b*), shows elevational and top views of a dispenser for housing/dispensing a plurality of tie devices.
Figure 5B:
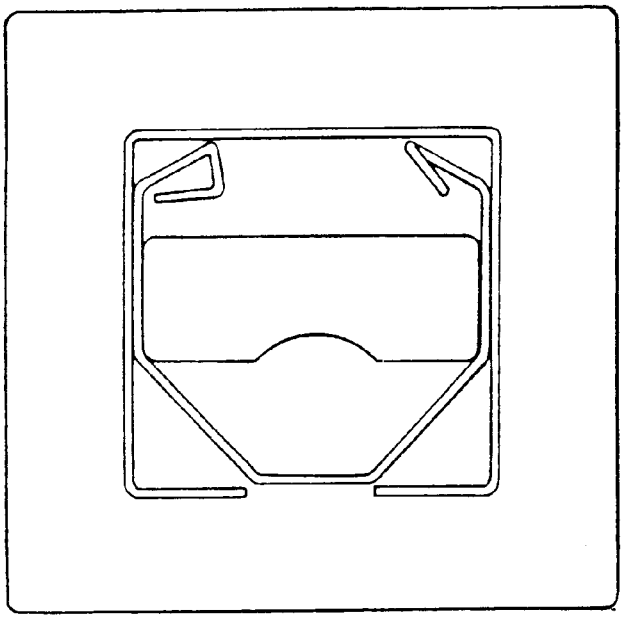

A suitable dispenser to store/supply the tie devices is shown in FIG. 5, FIG. 5*a* illustrating an elevational view thereof, and FIG. 5*b* illustrating a plan view thereof. As shown, the dispenser is provided with a plurality of tie devices 1 stacked therein.

Figure 6B:
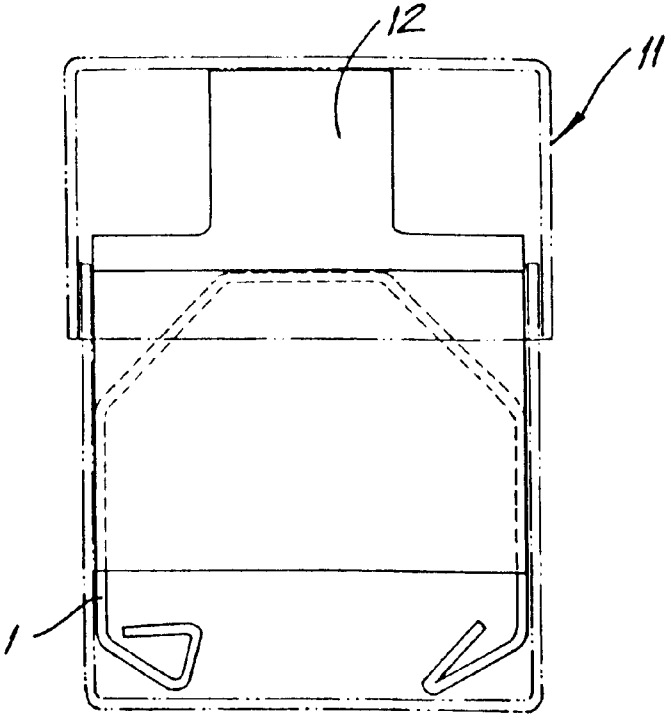
FIG. 6, in FIGS. 6(*a*) and 6(*b*), detail the inner operation of the magazine, showing side and front views thereof respectively housing a plurality of tie devices to deliver each tie device one at a time.
Figure 6A:
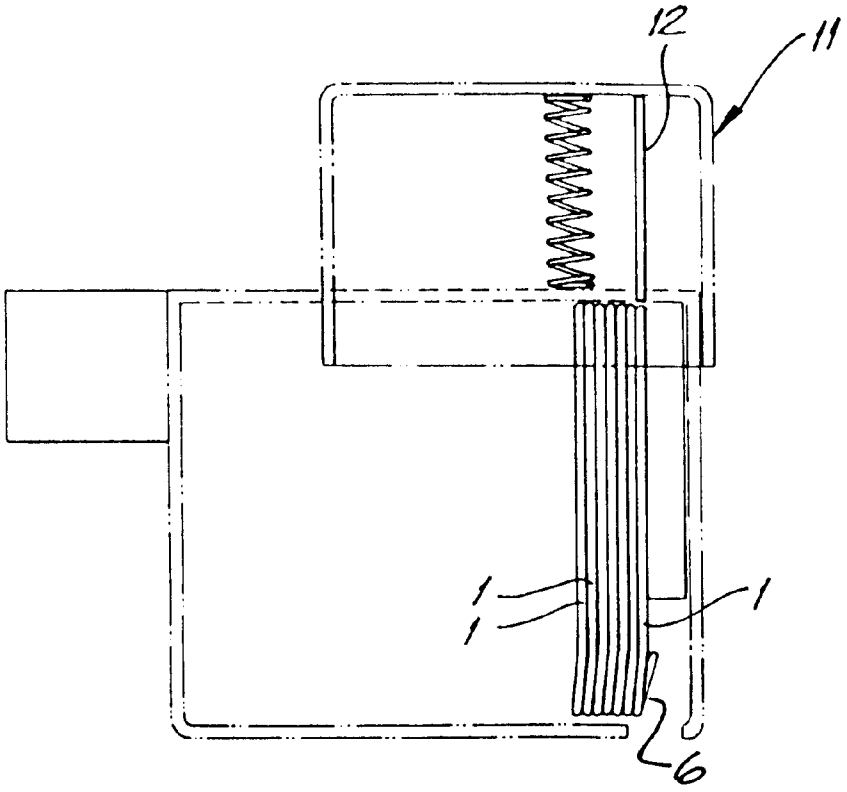

FIG. 6 illustrates the operation of a magazine 11, whereby each tie device may be selectively removed, one at a time. Attention is drawn to the guillotine like device 12, which "ejects" each tie device 1 from the magazine 11, one at a time. The magazine/dispenser allows supply of each tie device without becoming tangled.

Figure 7:
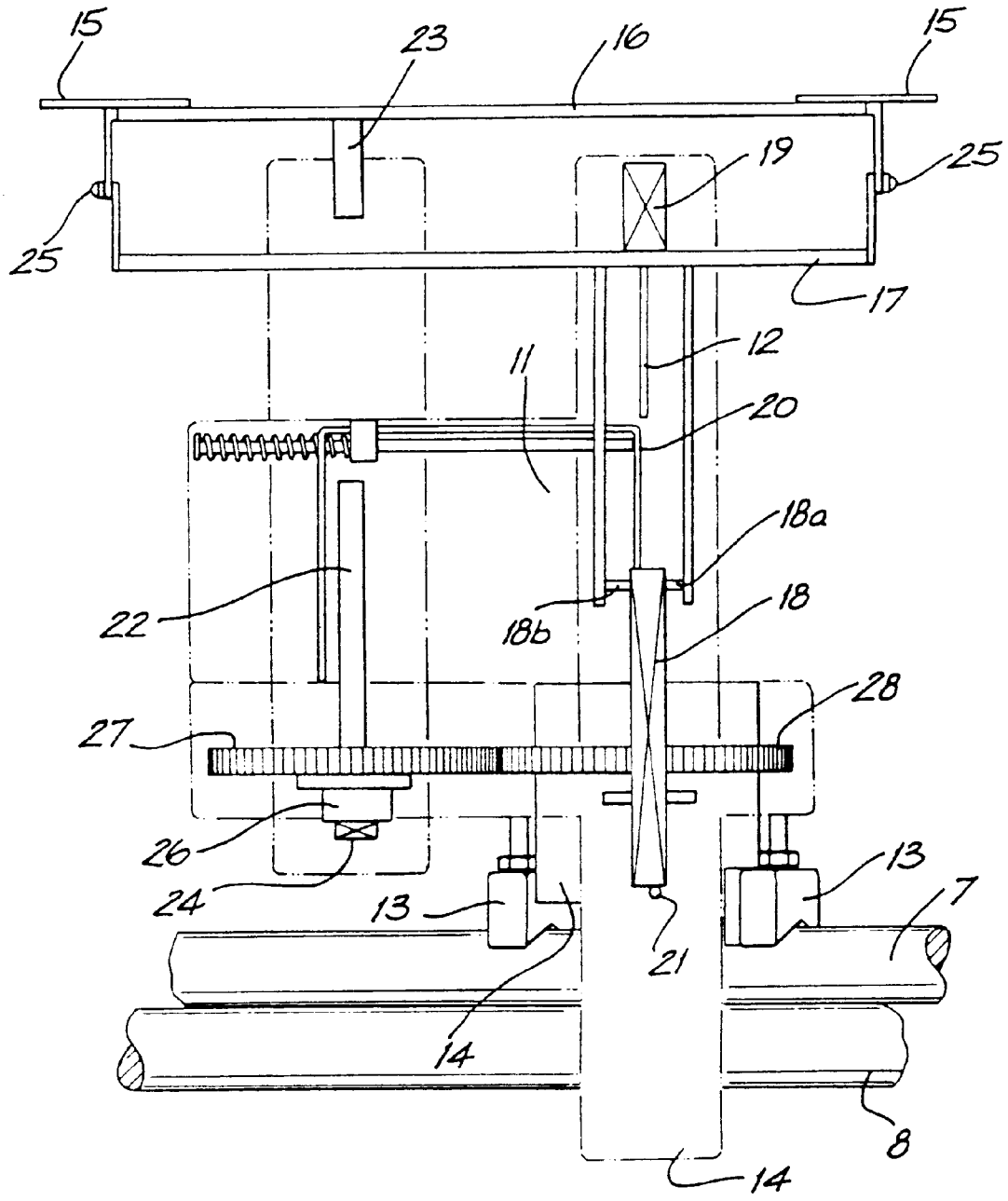
FIG. 7 shows a mechanical embodiment of a tying apparatus in accordance with the present invention.
Figure 8:
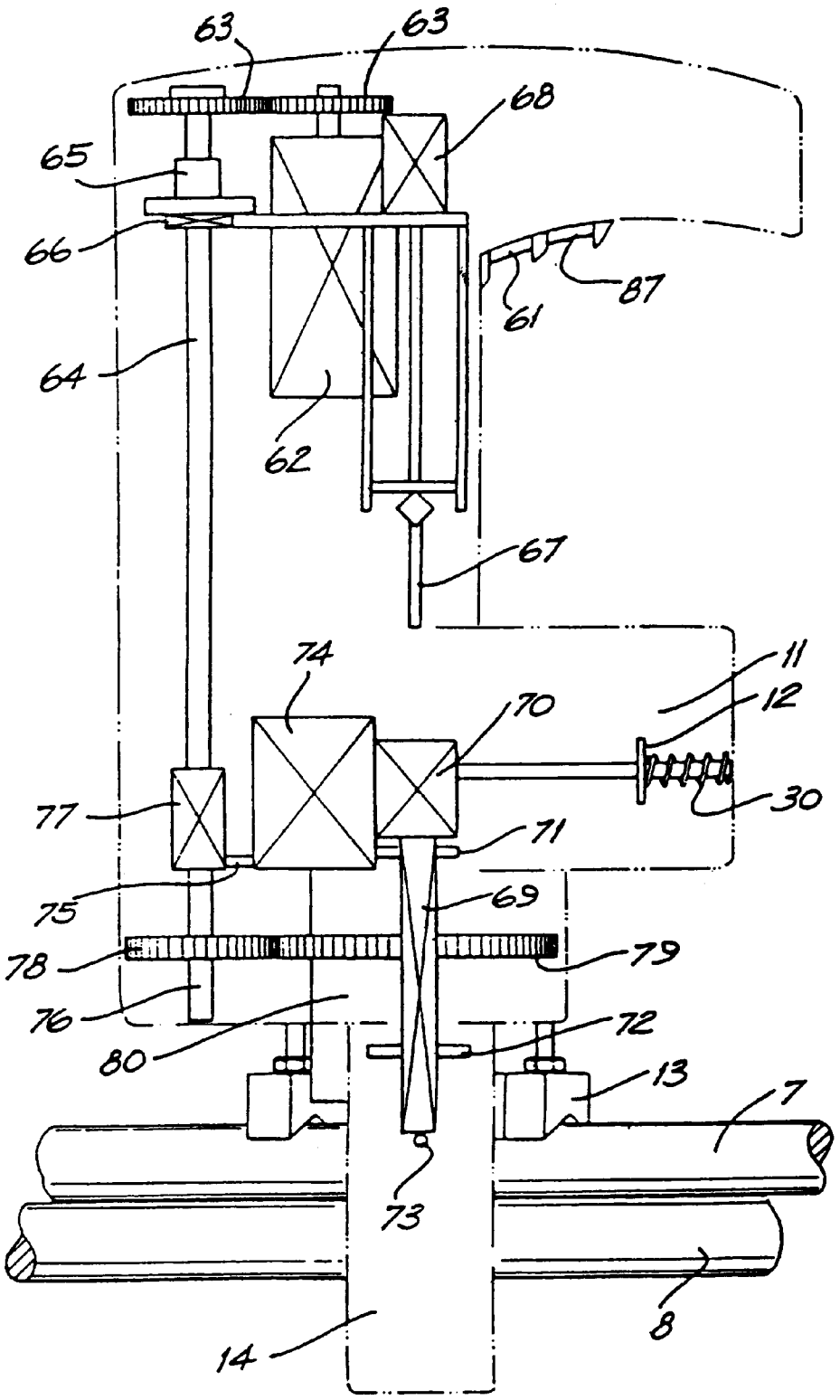
FIG. 8 shows an electrical embodiment of a tying apparatus.
Figure 9:
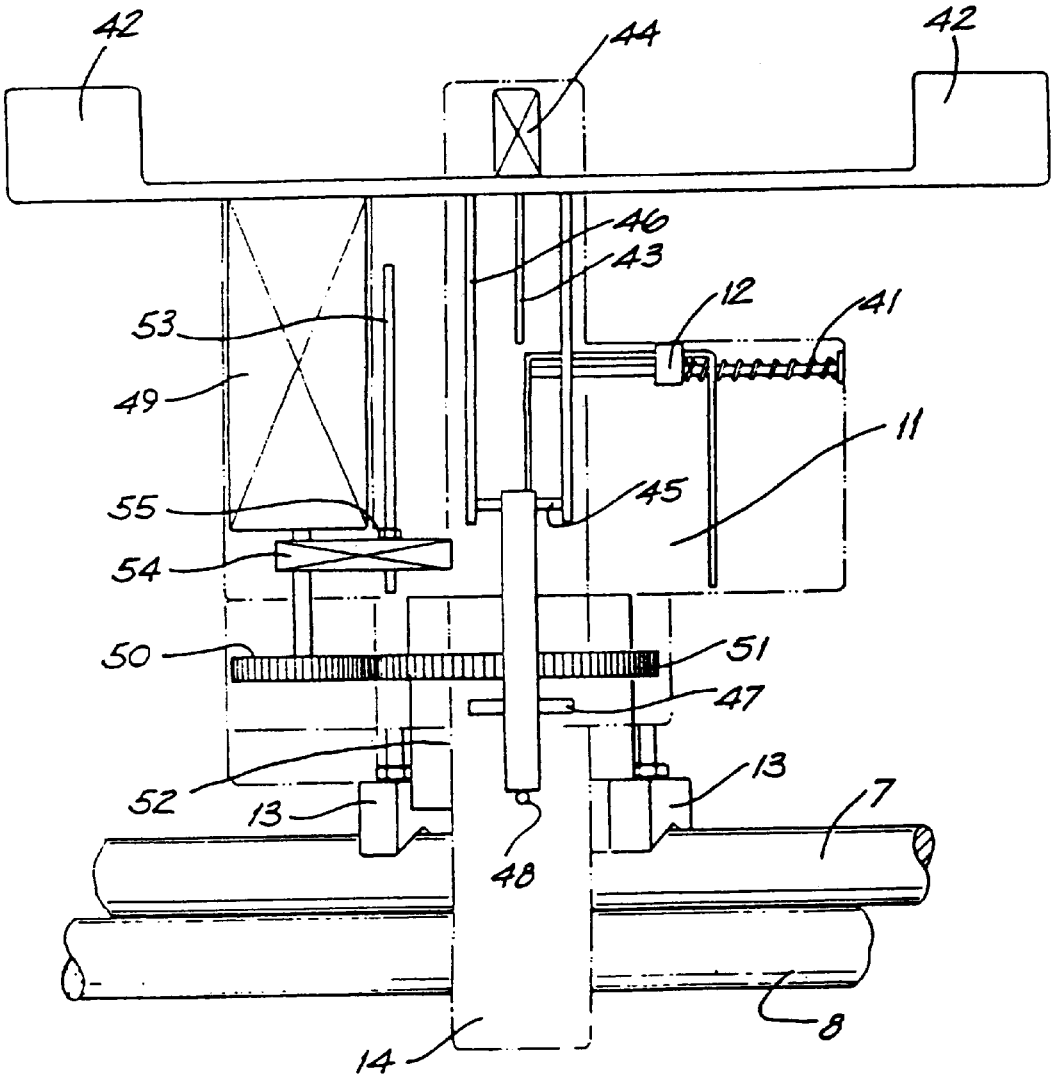
FIG. 9 shows an electromechanical embodiment of the tying apparatus.

FIG. 7, 8 and 9 illustrate different embodiments of tying apparatus in accordance with the present invention, FIG. 7 illustrating a mechanical machine, FIG. 8 illustrating an electromechanical machine and FIG. 9 illustrating an electrical machine. It will be appreciated that any combination of mechanical, hydraulic, pneumatic, electrical, and/or electromechanical or otherwise device may be utilised to implement the the tying operation of the present invention. Basically, a tying apparatus for tying a tie device about one or more objects to be tied comprises a deliver means to deliver each tie device to a tying position substantially about the objects to be tied, a connecting means to effect interengagement and connection of the hook portions of the tie device, and a twisting means to twist and thereby tighten the tie device about the object. The resultant tied tie device 1 should therefore appear as shown in FIG. 4.

The operation of the mechanical machine, shown in FIG. 7, will now be described.

A stack of tie devices 1 is provided within the magazine 11. The machine is placed diagonally and approximately centrally across the bars 7 and 8 with the saddles 13 resting on the top bar 7 and the coupler guide housing 14 straddling the bars 7 and 8.

The handles of the machine 15 are pressed down to move the top frame 16 and the bottom frame 17 in a downwards position. The shear blade or guillotine 12 connected to the bottom frame 17 shears the front tie device 1 from the stack thereof in the magazine 11 and delivers it to the couplers 18. The shear blade or guillotine 12 stops at this position being released from the bottom frame 17 by the engage release catch 19. At this same position, the coupler pivots 18*a* are engaged by the coupler drive plates 20 also connected to the bottom frame 17. As the handles continue to be pressed down, the couplers are driven down with the tie device now secured in the couplers. Relative positions of the coupler pivots 18*a* and 18*b* in the coupler guides control movement of the couplers, to position the tie device 1 around the bars 7 and 8 and bring the hooks together for coupling with the top of the loop formed resting on the twist rods 21. The down movement of the handles 15 is stopped at this position.

This down movement of the handles brings the top frame 16 into contact with screw shaft 22 through the drive rod 23 connected to the top frame and the arm 24 connected to the screw shaft 22. The top frame 16 is released from the bottom frame 17 by a finger control 25. The handles are continued to be pressed down to move the top frame down to the bottom frame. The screw shaft is driven down through the screw nut 26 which rotates. The screw nut, which is connected to the drive gear 27 rotates the drive gear and in turn the twist gear 28, its hollow shaft 80 and the twist rods 21 which are connected to the hollow shaft. The twist rods 21 twist the tie device 1 to form the tie. The screw shaft moves down against a spring and is locked down by a catch. With the tie device twisted and the twist rods now held firmly in the top loop that has been formed, the handles are pulled up so that the top and bottom frames are returned to their original positions.

At the end of this upward travel, the catch holding down the screw shaft is automatically released. The screw shaft moves up to reverse the direction of rotation of the screw nut and in turn the twist rods which spin the twist rods clear of the tie device allowing the machine to be removed. The twist shaft, hollow shaft and twist rods are returned to their original positions ready to receive the next tie device and the procedure is repeated.

Operation of an electrical machine, as depicted in FIG. 8, will now be described.

A stack of tie devices 1 is placed in the magazine 11 in front of the magazine drive plate 142 and its drive spring 30. The machine is placed diagonally and approximately centrally across the bars 7 and 8 with the saddles 13 resting on the top bar 7 and the coupler guide housing 14 straddling the bars 7 and 8.

The start switch 61 is pressed, which starts the D.C. gear-motor 62 and rotates the pair of gears 63. The gears 63 rotate the screw shaft 64 which drives the screw nut 65 down.

The carrier arms 66 are connected to the screw nut 65 and the shear blade or guillotine 67 through the engage/release catch 68. The shear blade 67 shears the front tie device 1 from the stack of tie devices and delivers it to the pair of couplers 69.

The shear blade stops at this position, being released from the carrier arms by the engage/release catch. The carrier arms engage the coupler engage/release catch 70 at this position and drive the couplers down with the tie device now secured in the couplers. The relative positions of the coupler pivots 71 and 72 in the coupler guides, control the movement of the couplers to position the tie device around the bars and to bring the hooks together for coupling, with the top of the loop formed resting on the twist rods 73.

The motor is stopped at this position by a microswitch. This switch supplies power to the solenoid 74 causing the solenoid arm 75 to move up to engage the screw shaft 64 with the drive shaft 76 through the clutch mechanism 77.

At the end of the solenoid arm travel, electrical contacts restart the motor in the reverse direction through a polarity relay.

The drive shaft rotates the drive gear 78 and in turn, the twist gear 79 its hollow shaft 80 and the twist rods 73 which are connected to the hollow shaft. The tie device is twisted to form the tie.

During this twisting action, the screw nut and carrier arms move back up the screw shaft releasing the couplers at their original positions through their engage/release catch. The screw nut continues its upward path to engage the shear blade through its engage/release catch and travels a short distance past its original position where the motor is stopped by a microswitch. The reset switch 81 is pressed when the motor stops which restarts the motor in the reverse direction through the polarity relay. This rotates the screw shaft and in turn, the twist rods in the reverse direction to the twisting action, which frees the rods from the tie device to allow the machine to be removed.

The motor is stopped by a microswitch when the shear blade reaches its original position above the front tie device in the magazine. This switch also cuts power to the solenoid which disengages the screw shaft from the drive shaft.

The D.C. motor is powered by rechargeable batteries. Space is available in the motor chamber for the batteries, relays and microswitches. The circuitry is arranged so that the switches cannot operate out of sequence.

An alternative to using microswitches and relays is to use a stepping motor controlled by a microprocessor.

The electromechanical machine, which is depicted in FIG. 9, will hereinafter be described.

A stack of tie devices is placed in the magazine 11 in front of the magazine drive 152 and its drive spring 41. The machine is placed diagonally and approximately centrally across the bars 7 and 8 with the saddles 13 resting on the top bar 7 and the coupler guide housing 14 straddling the bars.

The handles 42 are pressed down which moves the frame down. The shear blade or guillotine 67 connected to the frame shears the front tie device 1 from the stack thereof in the magazine 11 and delivers it to the coupler. The shear blade 43 stops at this position, being released from the frame by the engage/release catch 44. At this same position, the coupler pivots 45 are engaged by the coupler drive plates 46 connected to the frame. As the handles continue to be pressed down, the couplers are driven with the tie device now secured in the couplers. The relative positions of the coupler pivots 45 and 47 and in the coupler guides, control the movement of the couplers to position the tie device around the bars 7 and 8 and to bring the hooks thereof together for coupling, with the top of the loop formed resting on the twist rods 48.

The handles and frame are stopped at this position, where a microswitch starts the D.C. gear-motor 49. The D.C. motor 49 rotates the drive gear 50 and in turn, the twist gear 51, its hollow shaft 52 and twist rods 48 connected to the hollow shaft. The twist rods twist the tie device.

An auxilliary threaded shaft 53 is connected to the gear-motor shaft through a set of gears 54. A nut 55 which is restrained from turning, moves up the auxilliary shaft during the twisting action. The nut contacts a microswitch to stop the motor when the tie is completed.

With the tie completed and the twist rods held in the top loop that has been formed, the handles and frames are pulled up to their original positions.

At the end of this upward travel, a microswitch restarts the motor through a polarity relay in the reverse direction. The twist rods spin clear of the tie device and allow the machine to be removed. The nut travels back down the auxilliary shaft to its original position where a microswitch stops the motor. This reverse rotation also returns the hollow shaft and the twist rods to their original positions ready to receive the next tie device 1.

It should be understood from the foregoing description that a wide variety of different electrical, mechanical or electromechanical devices can be implemented to achieve the purpose of the device of the present invention.

It will be understood that one of the important features of the machine is the couplers to connect the hooks of the tie device so that the tie device can be twisted such that it is tied about the objects to be tied.

Details of a suitable coupler arrangement are shown in FIGS. 10 to 13. While there are a number of ways in which the tie devices can be delivered to the bars and twisted, the actual coupling or linking of the hooks together is fundamental and unique to the machine tying.

Referring to FIGS. 10 to 13, operation of the couplers follows.

Each hook is controlled by a coupler. The 'twisted' hook is enclosed by the fixed sides 125 of the coupler, FIG. 11, which holds the hook in the plane of the tie device for coupling. The top plate 126 engages the back of the leg of the tie device. The arm 128 shown in the closed position in FIGS. 11(*d*) and (*f*) secures the base of the tie device which, in conjunction with the other coupler, enables the tie device to be delivered to the bars. The arm is pivoted at 129 and is held closed by the guide rails 130 as shown in FIGS. 11(*c*) and (*f*), acting on it through the castors 131 against the spring 132.

The 'straight' hook is enclosed by the hinged sides 133 of its coupler as shown in FIG. 11, which also holds this hook in the plane of the tie device for coupling. The top plate 134 engages the back of the leg of the tie device. The pin 135 connected to one of the sides 133, shown in the closed position in FIGS. 12(*d*) and (*e*), secures the base of the tie device in the same way as the arm 128 of the other coupler. The sides 133 are pivoted at 136 and held closed by the guide rails 137, see FIGS. 12(*a*) and (*e*), acting on it through the castors 138 against the spring 139.

Figure 13A:
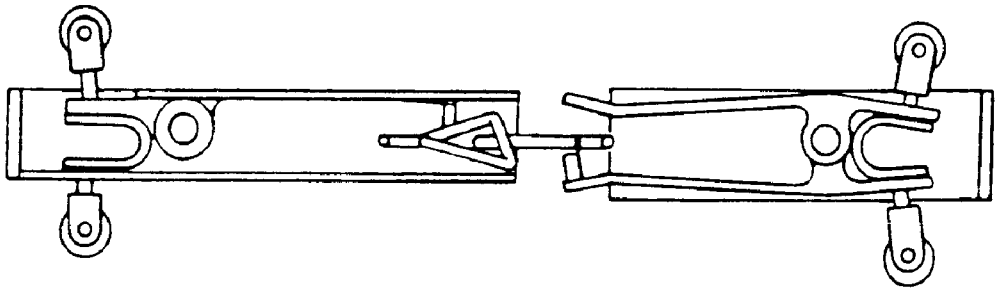
FIG. 13, in FIGS. 13(*a*) and 13(*b*) shows operation of the hooks of the tie device being engaged by the couplers; and, FIG. 14 shows a tying apparatus having an extension handle thereon.
Figure 13B:
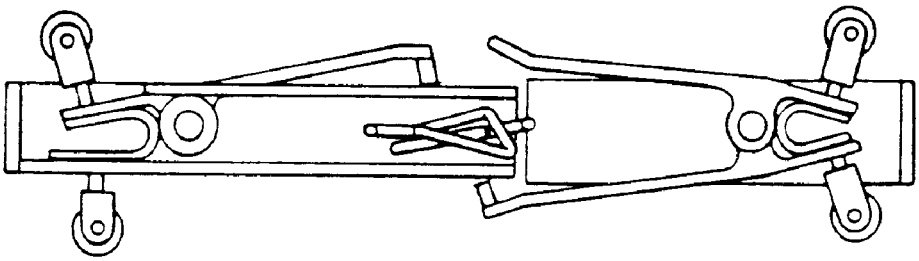

Controlled by the guide rails, the two couplers approach in the plane of the tie device. The shape of the 'twisted' hook ensures that the 'straight' hook will deflect passed the 'twisted' hook on the correct side to engage. The 'twisted' hook is held firmly in its coupler and does not deflect. The guides of the couplers are narrowed where the 'straight' hook just enters the 'twisted' hook coupler. This causes the arm 128 to rotate clear of its hook and the sides 133 to rotate clear of their hook. FIG. 11 (*b*) and (*g*) and FIG. 12 (*b*) and (*f*) show the guide rails narrowed to open the couplers. FIG. 13 (*a*) shows the couplers with the 'straight' hook just inside the 'twisted' hook coupler and the couples starting to open. FIG. 13(*b*) shows the hooks ready to engage with the couplers fully open.

The couplers stop when the hooks are ready to engage. The machine mechanism, the twist rods 117 and twist plates 142 fixed to the hollow shaft 116 then twists the loop formed in the tie device to complete the tie. The top of the loop is held by the twist rods, which causes the bottom of the loop (the hooks) to be drawn out of the couplers to the underside of the bars as the loop is twisted. At the same time, the hooks link one behind the other due to the inherent spring in the wire of the tie device. (In the case of electrical machine, the couplers actually move apart as soon as the twisting starts).

Figure 10:
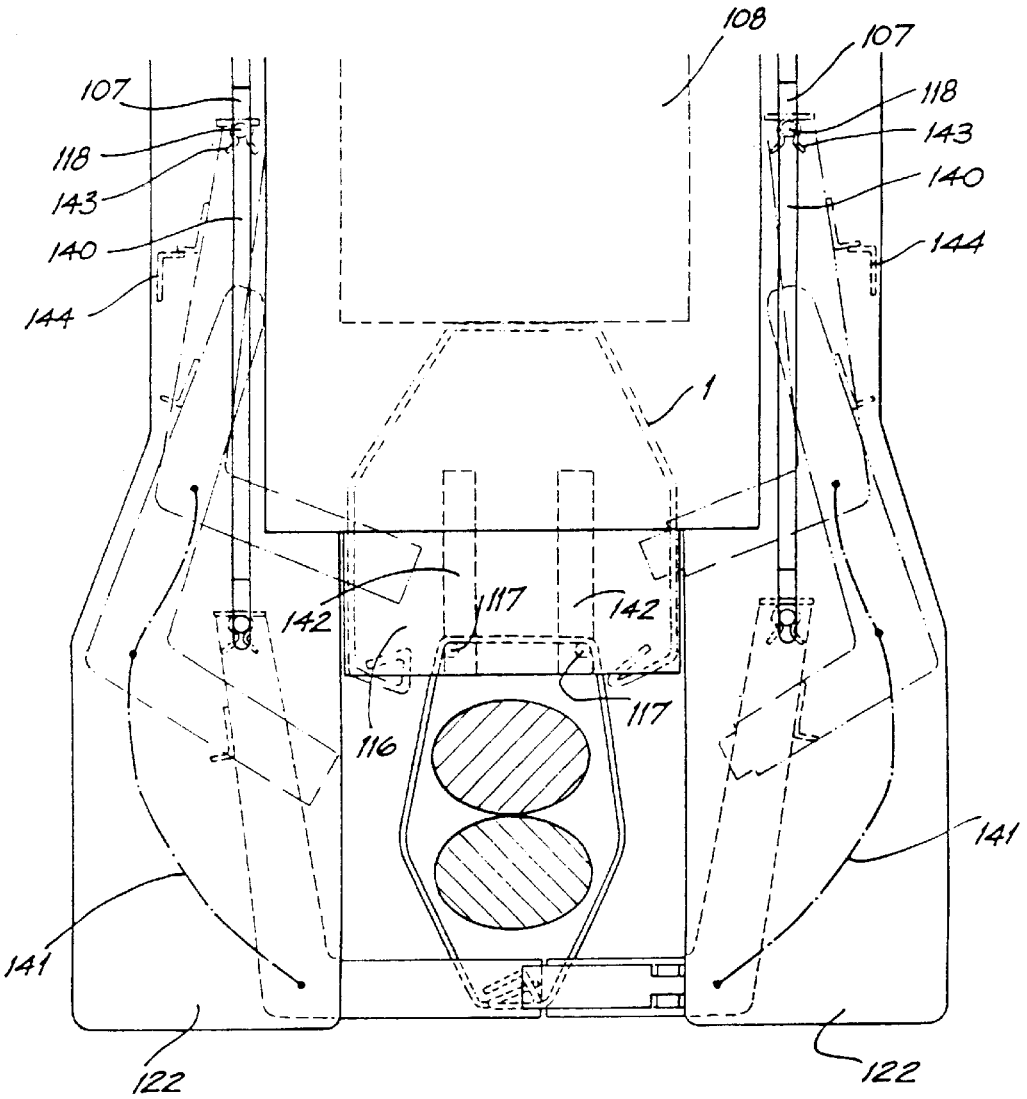
FIG. 10 details the coupler travel in the positioning of a tie device into its twisting position.
Figure 11C:
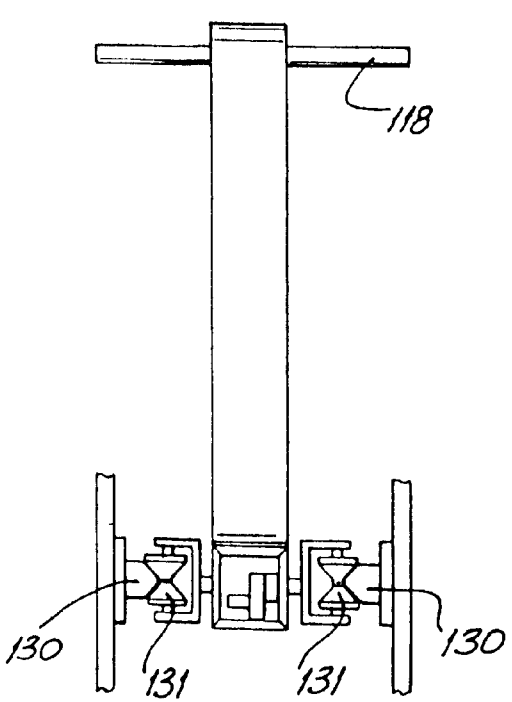
FIG. 11, in FIGS. 11(*a*) through 11(*g*) shows details of a coupler for a 'twisted hook'.
Figure 11B:
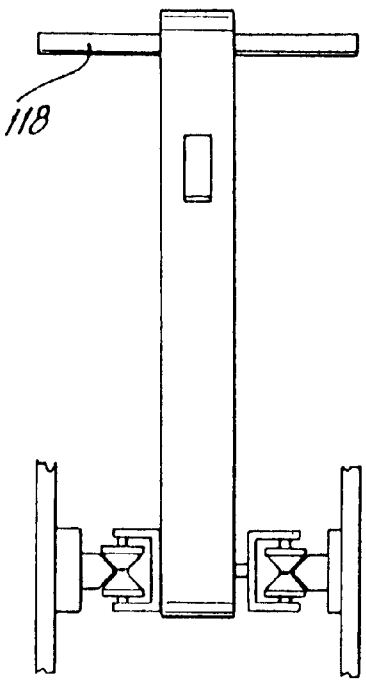
Figure 11A:
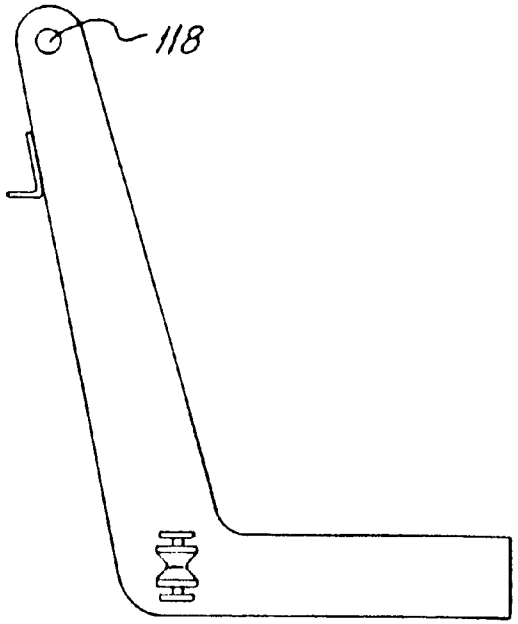
Figure 11D:
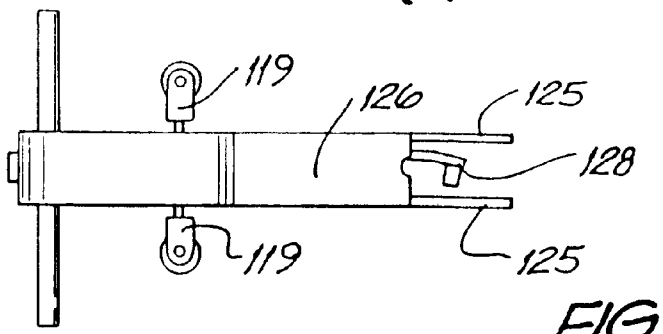
Figure 11E:
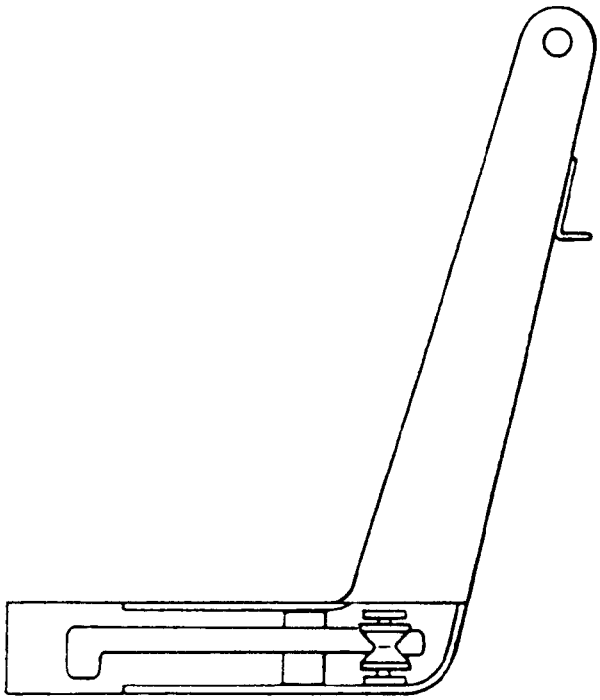
Figure 11F:
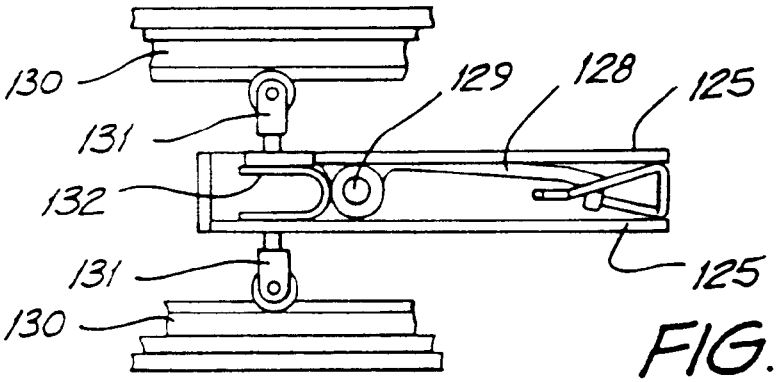
Figure 11G:
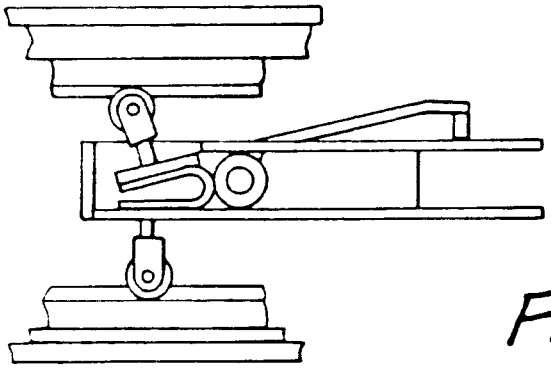
Figure 12C:
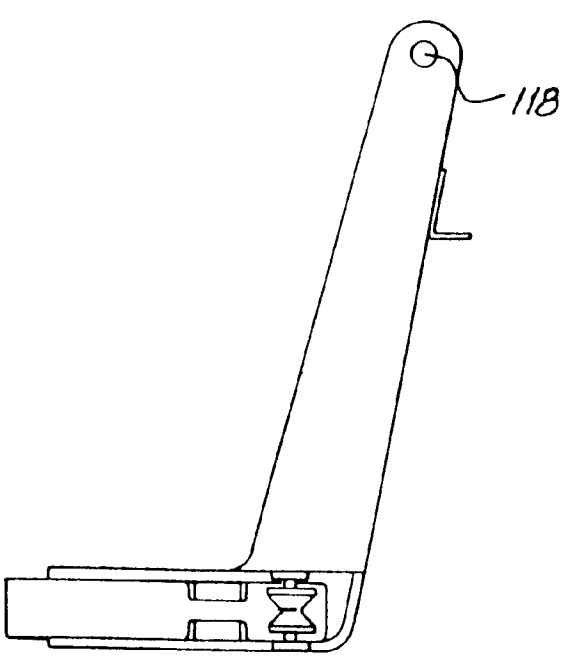
FIG. 12, in FIGS. 12(*a*) through 12(*f*) shows details of a coupler for a 'straight' hook.
Figure 12B:
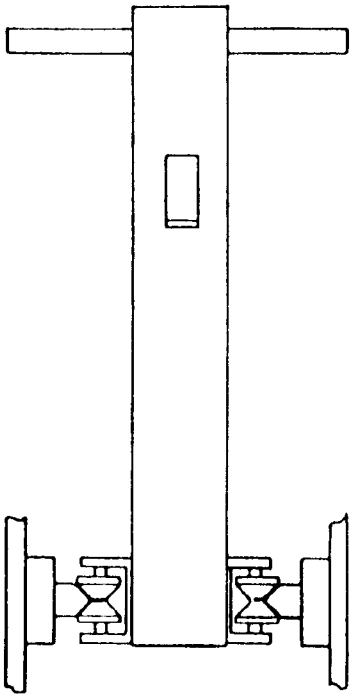
Figure 12A:
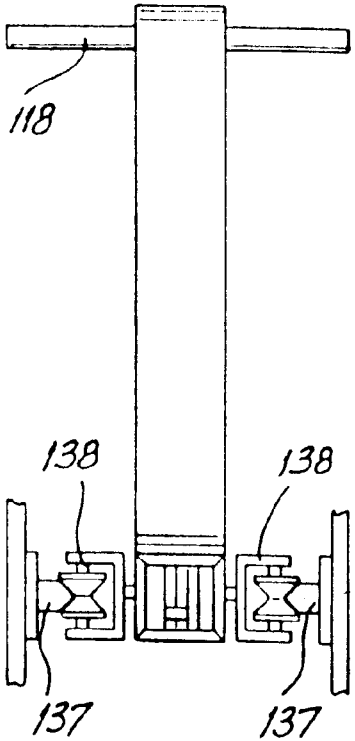
Figure 12E:
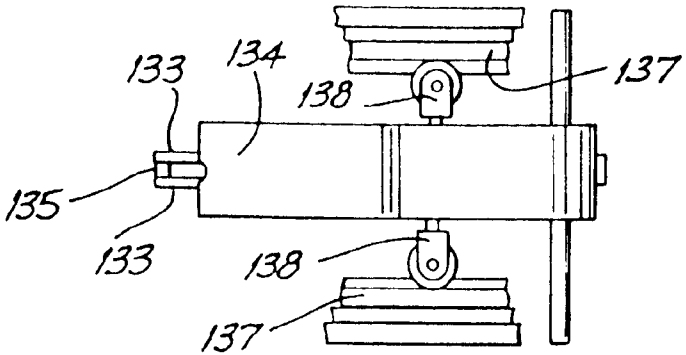
Figure 12D:
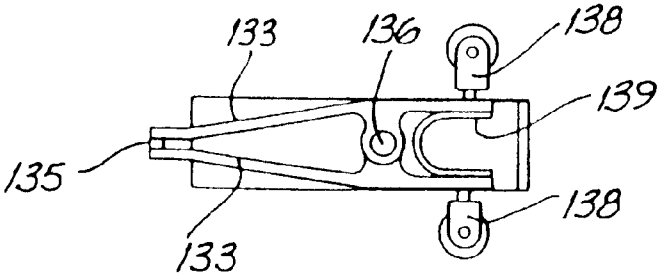
Figure 12F:
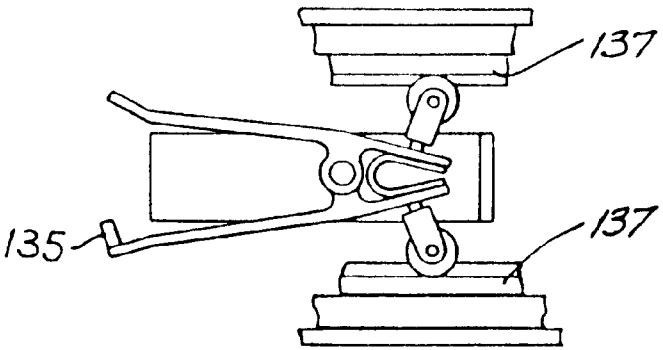

FIG. 10 shows the travel of the couplers from their fully up position ready to receive the tie device, to their fully down position ready to engage the hooks of the tie device. The pivots 118 of the couplers travel vertically in the slots 140 in the coupler guide housing 122. The couplers are open to receive the tie device and close around the legs of the tie device a short distance from this position controlled by the distance apart of the guide rails.

The guide rails 130 and 137 are fixed to the coupler guide housing along the paths 141. The couplers pivot on their castors at 119 which, in conjunction with the pivots 118 control the movement of the couplers as they are pushed down by the coupler drive plates 111, fixed to the bottom frame 17. Clips 143 fixed to the bottom frame, prevent the couplers from free falling. The spring steel catch 144 holds the couplers in their fully up position.

FIG. 10 also shows the tie device 142 delivered to the couplers by the shear blade in the fully up position and the couplers in the fully down position with the hooks ready to engage and the top of the tie device resting on the twist rods 117.

An important factor of this coupler action is that the couplers are approximately the same depth as the tie device, hooks, which means that the couplers can operate in a very small space, much smaller than the clearance normally provided between the bars and the formwork.

It will be understood that a wide variety of modifications achieving the same basic function will become apparent to persons skilled in the art.

Figure 14:
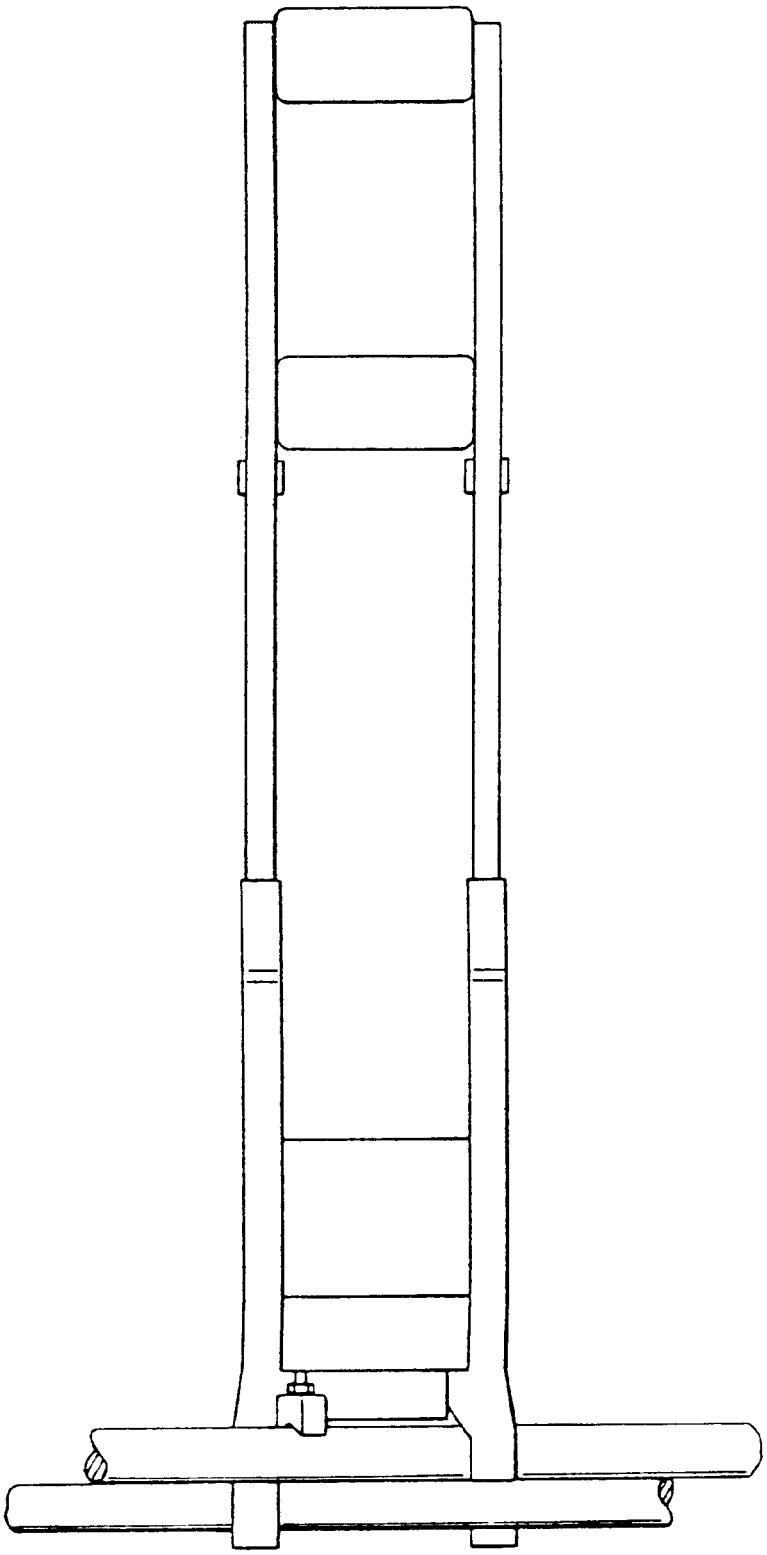

An example of a modification might be to adapt an extension handle to the device. An extension handle of course can be adapted to the device whether it be a mechanical, electrical, or electromechanical version of the machine. A type example of one embodiment of an extension handle is shown in FIG. 14. This enables an operator to access hard to get at areas to tie the reinforcing rods or other objects to be tied, which might be in an elevated or other hard position to reach. Such an extension handle also has the significant advantage of eliminating or at least reducing the amount of bending and/or kneeling by the operator. Such bending and/or kneeling causes damage to the knees and/or backs and/or other portions of an operator's body, which is a serious health concern within the construction industry.

The tying apparatus of the present invention will therefore be understood to be able to be used in a variety of forms. Likewise, it can be used in any orientation, but for the purposes of the description, it will be assumed to be used in the vertical position.

Whilst perhaps the primary application for the present invention is the tying of reinforcement rods in the construction of concrete slabs and the like, other applications for the device will become apparent. For example, the device may be utilised to tie the tops of bags or sacks such as chaff bags, for tying barbed or plain wire to star picket fence posts, for tying K-wire fencing or similar to steel frames, etc. All such applications should be considered to fall within the scope of the invention.

All such variations and modifications which become apparent to persons skilled in the art should be considered to fall within the scope of the invention as hereinbefore described and as hereinafter mentioned.

What is claimed is:

1. A tie device for tying at least two reinforcing bars together, the tie device being constructed of substantially ductile material, the tie device comprising:

a first elongated arm and a second elongated arm, the first elongated arm having a first free end and the second elongated arm having a second free end;

an intermediate portion coupled between the pair of elongated arms to form a tie plane and one of a substantially U and V-shaped configuration; and a means for fastening comprising a first hook means and a second hook means, the first hook means coupled to the first free end and the second hook means coupled to the second free end so that the first hook means and the second hook means face each other, wherein at least one of the hook means includes a plurality of bends shaped to at least partially extend out of the tie plane, the first hook means having at least two bends and the second hook means having at least two bends, the first hook means and the second hook means being adapted to move together and interengage upon application of an inward force to at least one elongated arm, and, upon subsequent release of the inward force, the first hook means remains securely interengaged with the second hook means to form a connection, and further wherein at least the intermediate portion is adapted to be twisted such that the connection deforms about the at least two reinforcing bars so as to increase the security of the interengagement of the connection as at least the intermediate portion is twisted.

2. The tie device of claim 1 wherein the plurality of bends extend out of the tie plane along a coil path.

3. A tie for connecting reinforcing bars, the tie comprising:

an intermediate portion having a first end and a second end;

a first elongated arm coupled to the first end of the intermediate portion;

a second elongated arm coupled to the second end of the intermediate portion;

a hook comprising a hook extension and a grapple, the hook extension having a first end coupled to the first elongated arm at an obtuse angle and a second end extending towards the second elongated arm, the grapple having a first end coupled to the second end of the hook extension at an acute angle and a second end extending towards the intermediate portion; and a loop comprising a loop extension and a catch, the loop extension having a first end coupled to the second elongated arm at an obtuse angle and a second end extending towards the first elongated arm, the catch having a first end coupled to the loop extension at an acute angle and a second end extending towards the intermediate portion.

4. The tie of claim 3 wherein the intermediate portion is coupled to the first elongated arm by a first curved portion and is coupled to the second elongated arm by a second curved portion such that the first curved portion and the second curved portion form a substantially U-like configuration.

5. The tie of claim 3 wherein the intermediate portion is coupled to the first elongated arm by a first angled portion and is coupled to the second elongated arm by a second angled portion such that the first angled portion and the second angled portion form a substantially V-like configuration.

6. The tie of claim 3 wherein the first elongated arm, the intermediate portion and the second elongated arm form a tie plane, the hook lying in the tie plane.

7. The tie of claim 6 wherein the loop extension extends away from the tie plane and the catch extends towards the tie plane.

8. The tie of claim 7 wherein the catch passes through the tie plane, the loop further comprising a catch extension having a first end coupled to the second end of the catch at an acute angle and extending towards the second elongated arm in the direction of the tie plane.

9. The tie of claim 3, the first elongated arm having a first portion and a second portion, the first portion of the first elongated arm having a first end and a second end, the first end of the first portion coupled to the first end of the intermediate portion, the second portion of the first elongated arm comprising a receding part and a protruding part, the receding part having a first end coupled to the second end of the first portion and having a second end that extends towards the second elongated arm, the protruding part having a first end coupled to the second end of the receding part and a second end that extends away from the second elongated arm and is coupled to the hook extension, and the second elongated arm having a first portion and a second portion, the first portion of the second elongated arm having a first end and a second end, the first end of the first portion coupled to the second end of the intermediate portion, the second portion of the second elongated arm comprising a receding part and a protruding part, the receding part having a first end coupled to the second end of the first portion and having a second end that extends towards the first elongated arm, the protruding part having a first end coupled to the second end of the receding part and a second end that extends away from the first elongated arm and is coupled to the loop extension.

10. The tie of claim 9 wherein the first elongated arm, the intermediate portion and the second elongated arm form a tie plane, the hook lying in the tie plane.

11. The tie of claim 10 wherein the loop extension extends away from the tie plane and the catch extends towards and through the tie plane.

12. The tie of claim 12 wherein the tie has a circular cross-sectional shape.

13. The tie of claim 12 wherein the tie is made of a ductile, resilient material.

14. The tie of claim 13 wherein the material is one of metal and plastic.

15. A tie for connecting reinforcing bars, the tie comprising:

an intermediate portion having a first end and a second end;

a first elongated arm coupled to the first end of the intermediate portion;

a second elongated arm coupled to the second end of the intermediate portion;

a first crook having a first end coupled to the first elongated arm, the first crook extending at least in part towards the second elongated arm; and a second crook having a first end coupled to the second elongated arm, the second crook extending at least in part towards the first elongated arm, wherein the first elongated arm, the intermediate portion and the second elongated arm form a tie plane, the first crook comprising a first portion and a second portion, the first portion of the first crook coupled to the first elongated arm and extending below and away from the tie plane and the second portion of the first crook extending towards the tie plane and the intermediate portion, the second crook comprising a first portion and a second portion, the first portion of the second crook coupled to the second elongated arm and extending above and away from the tie plane and the second portion of the second crook extending towards the tie plane and the intermediate portion.

16. The tie of claim 15 wherein the intermediate portion is coupled to the first elongated arm by a first curved portion and is coupled to the second elongated arm by a second curved portion such that the first curved portion and the second curved portion form a substantially U-like configuration.

17. The tie of claim 15 wherein the intermediate portion is coupled to the first elongated arm by a first angled portion and is coupled to the second elongated arm by a second angled portion such that the first angled portion and the second angled portion form a substantially V-like configuration.

18. The tie of claim 15 wherein the second portion of the first crook is coupled to a first crook extension, the second portion of the second crook is coupled to a second crook extension, and wherein at least one of the crook extensions passes through the tie plane.

19. In a reinforced concrete structure having a tie that fixes a plurality of reinforcing bars to each bar, the tie comprising:

an intermediate portion having a first end and a second end;

a first elongated arm coupled to the first end of the intermediate portion, the first elongated arm having a first portion and a second portion;

a second elongated arm coupled to the second end of the intermediate portion, the second elongated arm having a first portion and a second portion; and a means for fastening the second portion of the first elongated arm to the second portion of the second elongated arm, the means for fastening adapted to be interengaged, wherein the first portion of the first elongated arm and the first portion of the second elongated arm include a position wherein each first portion is twisted around the other to form an entwined portion wherein the entwined portion is a result of a process that includes the step of twisting without pulling, the entwined portion having a length such that the means for fastening securely engages and deforms about the plurality of reinforcing bars, whereby the security of the interengagement of the means for fastening increases as the length of the entwined portion increases.

20. In a reinforced concrete structure having a tie that fixes a plurality of reinforcing bars to each bar, the tie of claim 19 wherein the means for fastening comprises a hook and a loop, the hook comprising a hook extension and a grapple, the hook extension having a first end coupled to the first elongated arm at an obtuse angle and a second end extending towards the second elongated arm, the grapple having a first end coupled to the second end of the hook extension at an acute angle and a second end extending towards the intermediate portion, and the loop comprising a loop extension and a catch, the loop extension having a first end coupled to the second elongated arm at an obtuse angle and a second end extending towards the first elongated arm, the catch having a first end coupled to the loop extension at an acute angle and a second end extending towards the intermediate portion so that the loop and the hook face each other.

21. In a reinforced concrete structure having a tie that fixes a plurality of reinforcing bars to each bar, the tie of claim 19 wherein the means for fastening comprises a first crook and a second crook, the first crook having a first end coupled to the first elongated arm, the first crook extending at least in part towards the second elongated arm; and the second crook having a first end coupled to the second elongated arm, the second crook extending at least in part towards the first elongated arm.

22. A magazine for use in a tie gun, the magazine comprising:

a plurality of tie devices, each tie device having a top side profile, a bottom side profile, an intermediate portion having a first end and a second end, a first elongated arm coupled to the first end of the intermediate portion, the first elongated arm having a first portion and a second portion, a second elongated arm coupled to the second end of the intermediate portion, the second elongated arm having a first portion and a second portion, and a means for fastening the second portion of the first elongated arm to the second portion of the second elongated arm, the means for fastening adapted to be interengaged, wherein the intermediate portion, the first elongated arm, the second elongated arm, and the means for fastening are configured so that the bottom side profile of each tie device in the plurality of tie devices is complementary in shape to the top side profile of the remaining tie devices in the plurality of tie devices and wherein the intermediate portion, the first elongated arm, and the second elongated arm form a tie plane, the means for fastening comprises a hook and a loop, and at least one of the hook and the loop spiral through the tie plane and wherein, except for a first tie device, the bottom side profile of each tie device in the plurality of tie devices is stacked on the top side profile of any other tie device in the plurality of tie devices in a nesting fashion.

23. The magazine of claim 22 wherein the intermediate portion, the first elongated arm, and the second elongated arm form a tie plane, the means for fastening comprises a first crook and a second crook, and at least one of the first crook and the second crook spiral through the tie plane.

24. In a tying apparatus used in securing at least two reinforcing bars to one another, a tie device suitable for use in the tying apparatus, the tying apparatus comprising:

a frame;

means for delivering coupled to the frame and having disposed therein the tie device;

means for connecting coupled to the frame; and means for twisting coupled to the frame, the means for twisting including at least one of a twist rod and a twist plate disposed substantially perpendicular to the position of the tie device, the at least two reinforcing bars having a first side and a second side substantially opposed to the first side, the tie device having a pair of elongated arms in one of a substantially U-shaped and V-shaped configuration and an intermediate portion coupled between the pair of elongated arms, each of the pair of elongated arms having a free end portion including a means for hooking, each means for hooking having at least two bends, wherein the means for delivering is adapted to deliver the tie device to the means for connecting as an accepted tie device, wherein the means for connecting is adapted to deliver the accepted tie device to a tying position about
(i) the reinforcing bars and
(ii) one of the twist rod and the twist plate, such that the intermediate portion of the tie device is adjacent to one of the twist rod and the twist plate and the means for hooking are provided beyond the second side of the reinforcing bars in a position that is complimentary to each other, wherein the means for connecting interengages the means for hooking when the tie device is in the tying position, and wherein the means for twisting is adapted to operatively engage the tie device about the intermediate portion of the tie device at a twist position and further is adapted to twist the tie device substantially about the twist position by rotating the twist rod or the twist plate such that the security of the interengagement of the means for hooking of the tie device increases as the twist rod or the twist plate is twisted.

25. A tie device disposed about at least two reinforcing bars, wherein the tie device disposed about at least two reinforcing bars is a result of a process that includes:

providing a tying apparatus having a displaceable tie device positioned in the tying apparatus, the displaceable tie device having an intermediate portion, the tying apparatus adapted to deliver and tie the displaceable tie device about the at least two reinforcing bars, the displaceable tie device having a pair of elongated arms in one of a substantially U-shaped and V-shaped configuration and having an intermediate portion coupled between the pair of elongated arms and each elongated arm having an end portion, the pair of elongated arms having a complimentary means for hooking at the end portions thereof, the tying apparatus including:

means for delivering adapted to accept the displaceable tie device as an accepted tie device and adapted to deliver the accepted tie device to a means for connecting, the means for connecting adapted to deliver the accepted tie device to a tying position about the at least two reinforcing bars and adapted to interengage the complimentary means for hooking of the accepted tie device, and means for twisting coupled to a frame, the means for twisting including at least one of a twist rod and a twist plate disposed substantially perpendicular to the position of the displaceable tie device in the tying apparatus, the means for twisting adapted to twist the intermediate portion of the accepted tie device by rotating the twist rod or the twist plate;

positioning the accepted tie device about a first side of the at least two reinforcing bars such that the complimentary means for hooking are positioned on a second side of the bars;

interengaging the complimentary means for hooking; and twisting the intermediate portion of the displaceable tie device by rotating the twist rod or twist plate to operatively engage the intermediate portion of the accepted tie device and twist and tighten the accepted tie device about the at least two reinforcing bars, the security of the interengagement of the complimentary means for hooking increasing as the accepted tie device is twisted.

* * * * *